United States Patent [19]

Schulz et al.

[11] 4,108,788

[45] Aug. 22, 1978

[54] LIQUID DIELECTRIC COMPOSITION DERIVED FROM THE ALKYLATION PRODUCT OF BENZENE WITH ETHYLENE

[75] Inventors: Johann G. D. Schulz, Pittsburgh; Charles M. Selwitz; Anatoli Onopchenko, both of Monroeville, all of Pa.

[73] Assignee: Gulf Research & Development Company, Pittsburgh, Pa.

[21] Appl. No.: 817,694

[22] Filed: Jul. 21, 1977

[51] Int. Cl.[2] ..... C10M 3/10; C10M 3/12; H01B 3/22

[52] U.S. Cl. ..... 252/63; 260/671 R; 260/671 G; 260/674 A

[58] Field of Search ..... 252/63; 260/671 R, 671 G, 260/674 A, 674 SA; 361/315, 327; 174/17 LF

[56] References Cited

U.S. PATENT DOCUMENTS

| | | | |
|---|---|---|---|
| 2,403,785 | 7/1946 | Britton et al. | 260/671 R |
| 2,653,979 | 9/1953 | Krupa et al. | 252/63 X |
| 3,600,298 | 8/1971 | Mayumi et al. | 260/671 G X |
| 3,786,107 | 1/1974 | Kuribayashi et al. | 260/671 G X |
| 4,011,274 | 3/1977 | Watanabe et al. | 260/671 R X |
| 4,033,854 | 7/1977 | Ohmuri et al. | 252/63 X |

FOREIGN PATENT DOCUMENTS 732,900 6/1955 United Kingdom.

*Primary Examiner*—Harris A. Pitlick

[57] ABSTRACT

A liquid dielectric composition obtained as a result of a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products by distillation in the presence of a basic material a fraction having a boiling point in the temperature range of about 255° to about 420° C., preferably about 265° to about 400° C., most preferably about 275° to about 400° C., as said dielectric composition.

12 Claims, No Drawings

LIQUID DIELECTRIC COMPOSITION DERIVED FROM THE ALKYLATION PRODUCT OF BENZENE WITH ETHYLENE

BACKGROUND OF THE INVENTION

1. Field of the Invention

The invention defined herein relates to a liquid dielectric composition obtained as a result of a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products by distillation in the presence of a basic material a fraction having a boiling point in the temperature range of about 255° to about 420° C., preferably about 265° to about 400° C., most preferably about 275° to about 400° C., (including any portion thereof) as said dielectric composition.

2. Description of the Prior Art

Polychlorinated biphenyls have been extensively employed commercially in the electrical industry over a long period of time as liquid insulating fluids, but because of environmental and toxicological problems associated therewith, substitutes therefor are required.

SUMMARY OF THE INVENTION

We have found that a liquid dielectric composition can be obtained from a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products by distillation in the presence of a basic material a fraction having a boiling point in the temperature range of about 255° to about 420° C., preferably about 265° to about 400° C., most preferably about 275° to about 400° C. as said dielectric composition.

BRIEF DESCRIPTION OF THE INVENTION

In our U.S. patent application Ser. No. 817,695 (Case A), filed concurrently herewith, entitled Liquid Dielectric Composition, we have discovered that we can obtain liquid dielectric compositions as a result of a process which comprises reacting benzene with ethylene in the presence of an alkylation catalyst to obtain an alkylation product containing largely unreacted benzene, ethylbenzene, polyethylbenzenes, 1,1-diphenylethane and heavier products, separating benzene, ethylbenzene, polyethylbenzenes and 1,1-diphenylethane from said alkylation product and thereafter recovering from said heavier products a fraction having a boiling point in the temperature range of about 275° to about 420° C., preferably about 280° to about 400° C., as said liquid dielectric composition.

We have now found that if we remove from the alkylation product defined above unreacted benzene, ethylbenzene and polyethylbenzenes and then subject the residue to distillation in the presence of a basic material we can recover from said residue a fraction having a boiling point in the temperature range of about 255° to about 420° C., preferably about 265° to about 400° C., most preferably about 275° to about 400° C., as a liquid dielectric composition having an appreciably lower power factor than fractions not similarly distilled in the presence of a basic material, especially when said liquid dielectric composition claimed herein is employed at higher temperatures.

Briefly, the process employed in obtaining the new liquid dielectric compositions defined and claimed herein comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products by distillation in the presence of a basic material a fraction having a boiling point at atmospheric pressure (ambient pressure) in the temperature range of about 255° to about 420° C., preferably about 265° to about 400° C., most preferably about 275° to about 400° C., as said liquid dielectric composition.

The alkylation of benzene with ethylene that can be employed to obtain the new liquid dielectric compositions claimed herein can be any of the processes known in the art for producing a product containing ethylenzene, for example, either liquid phase alkylation or vapor phase alkylation. The molar ratios of benzene to ethylene employed can be, for example, in the range of about 25:1 to about 2:1, preferably about 10:1 to about 3:1. In the liquid phase reaction, for example, the benzene and ethylene, together with an alkylation catalyst, for example, a Friedel Crafts catalyst, such as aluminum chloride, or aluminum bromide or some other organoaluminum halide; Lewis acid, such as promoted $ZnCl_2$, $FeCl_3$ and $BF_3$; and Bronsted acids, including sulfuric acid, sulfonic acid and p-toluene sulfonic acid, hydrofluoric acid, etc., in an amount corresponding to about 0.002 to about 0.050 parts, preferably about 0.005 to about 0.030 parts, relative to ethylbenzene produced, are reacted in a temperature range of about 20° to about 175° C., preferably about 90° to about 150° C., and a pressure in the range of about atmospheric to about 250 pounds per square inch gauge (about atmospheric to about 17.6 kilograms per square centimeter), preferably about seven to about 200 pounds per square inch gauge (about 0.5 to about 14 kilograms per square centimeter), for about 10 minutes to about 10 hours, preferably for about 20 minutes to about 3 hours. In the vapor phase, for example, the reactants can be passed over a suitable alkylation catalyst bed containing alkylation catalysts such as phosphoric acid on kieselguhr, silica or alumina, aluminum silicates, etc. at a convenient space velocity in a temperature range of about 250° to about 450° C., preferably about 300° to about 400° C., and a pressure of about 400 to about 1200 pounds per square inch gauge (about 28 to about 85 kilograms per square centimeter), preferably about 600 to about 1000 pounds per square inch gauge (about 42 to about 70 kilograms per square centimeter).

As a result of such reactions, an alkylation product is obtained containing unreacted benzene, the desired ethylbenzene, polyethylbenzenes, such as diethylbenzene and triethylbenzene, and higher-boiling products.

The akylation product can be treated in any conventional manner to remove any alkylation catalyst present therein. For example, when aluminum chloride is used as catalyst, the alkylation product can be sent to a settler wherein the aluminum chloride complex is removed and recycled to the reaction zone and the remaining product can then be water washed and neutralized.

The resulting alkylation product is then distilled at atmospheric pressure or under vacuum to recover unreacted benzene (B.P. 80° C.), ethylbenzene (B.P. 136° C.) and polyethylbenzenes (B.P. 176°-250° C.).

The heavier product remaining after removal of benzene, ethylbenzene and polyethylbenzenes, as described above, is a dark, viscous, high-boiling material from which the novel liquid dielectric compositions defined and claimed herein are obtained. To obtain the claimed novel liquid dielectric composition, the said heavier product is simply subjected to distillation in the presence of a basic material and those portions recovered having a boiling point at atmospheric pressure (14.7 pounds per square inch gauge or 760 millimeters of mercury) in the temperature range of about 255° to about 420° C., preferably about 265° to about 400° C., most preferably about 275° to about 400° C., constitute the desired and novel liquid dielectric composition. The remaining heavier material or residue is a black asphalt-like material solid at ambient temperature believed, in part, to be polynuclear structure having fuel value only.

The basic material present during the distillation defined above is selected from the group consisting of Group I and Group II alkali metals and alkaline earth metals, their oxides and hydroxides. Of these lithium, sodium, potassium, magnesium, calcium, strontium and barium, their oxides and hydroxides are preferred. The amount of basic material in the distillation zone can be, for example, in the range of about 0.5 to about 20 weight percent, preferably about one to about 10 weight percent, based on the weight of the charge being subjected to distillation. Preferably the distillation is carried out while stirring the mixture or in the presence of boiling chips to avoid bumping. If desired reduced or increased pressure can be used during the distillation, with the temperature being correlated therewith so that the material distilled off and recovered herein will be those portions of the heavier product, defined above, corresponding to those portions having a boiling point at atmospheric pressure of about 255° to about 420° C., preferably about 265° to about 400° C., most preferably about 275° to about 400° C. The residue remaining after such distillation is a black asphalt-like material solid at ambient temperature having fuel value only.

It is critical herein that said distillation be carried out in the presence of the basic material defined above. If the bottoms to be distilled are treated with the basic material prior to distillation emulsion problems result, and it is then difficult to separate the two phases. If, on the other hand, the bottoms are first distilled and the desired fractions are then treated with the basic material, it is exceedingly difficult to remove the last traces of basic material from the desired fractions, causing the material to lose some of its insulating capability. In addition such treatment also results in emulsion problems.

DESCRIPTION OF PREFERRED EMBODIMENTS

A number of liquid dielectric compositions were prepared from the residue, or heavier products, obtained as a result of the production of ethylbenzene. This residue was obtained as follows. Benzene and ethylene in a molar ratio of 9:1 were contacted in the liquid phase, while stirring, in a reactor at a temperature of 130° C. and a pressure of 70 pounds per square inch gauge (4.9 kilograms per square centimeter) in the presence of $AlCl_3$ catalyst over a period of 1 hour, which was sufficient to convert all of the ethylene. The $AlCl_3$ complex catalyst was prepared by dissolving $AlCl_3$ in a polyethylbenzene cut from a previous run so that after the addition the composition of the catalyst complex was as follows: 31.5 weight percent $AlCl_3$, 7.0 weight percent benzene, 19.3 weight percent ethylbenzene, 29.8 weight percent polyalkylated benzenes, 3.4 weight percent 1,1-diphenylethane and 9.0 weight percent higher-boiling components. The amount of $AlCl_3$ present in the catalyst mixture amounted to 0.0034 parts by weight per one part by weight of ethylbenzene produced. Also present in the catalyst was ethyl chloride promoter in an amount corresponding to 0.0034 parts by weight per one part by weight of ethylbenzene produced to maintain a high catalyst efficiency. Analysis of the alkylation product showed the presence of 49.0 weight percent benzene, 32.9 weight percent ethylbenzene, 17.5 weight percent of polyalkylated benzenes (6.0 weight percent diethylbenzene, 2.7 weight percent triethylbenzenes, 2.1 weight percent tetraethylbenzenes and 6.7 weight percent other alkylbenzenes), 0.1 weight percent 1,1-diphenylethane and 0.4 weight percent residue. The alkylation product was subjected to distillation to recover unreacted benzene, ethylbenzene and polyalkylated benzenes, and the benzene and polyakylated benzenes were recycled to the reaction zone. The residue remaining was a dark, viscous, high-boiling material, and was produced in an amount corresponding to 0.014 parts for each part of ethylbenzene produced. By using aged aluminum chloride complex, the amount of high-boiling residue formed can be increased substantially.

The residue obtained was subjected to distillations at atmospheric pressure arbitrarily to obtain selected cuts thereof. One cut (Run No. 1 in Table I below) was untreated. Another cut (Run No. 2) was washed three times with a 10 percent aqueous sodium hydroxide solution prior to distillation. A third cut (Run No. 3) was washed three times with a 10 percent aqueous sodium hydroxide solution, then with water and dried. The remaining cuts (Runs Nos. 4, 5, 6, 7 and 8) were distilled in the presence of selected basic materials at atmospheric pressure. Each of the above was subjected to tests (ASTM-D924) at 25° and 100° C. to determine its power factors and dielectric strength. The result obtained are set forth below in Table I.

TABLE I

| Run No. | Boiling Point Range Of Cut, ° C. | Treatment | Dielectric Strength, kV | Power Factor At 25° C. | Power Factor At 100° C. |
|---|---|---|---|---|---|
| 1 | 278-400 | No treatment | 50+ | 0.075 | 3.1 |
| 2 | 260-400 | Distilled after washing with NaOH | 50+ | 0.08 | 2.0 |
| 3 | 278-400 | Cut was washed with NaOH, water and dried | 15 | 0.30 | 13 |
| 4 | 278-400 | Distilled in the presence of 0.64 weight per cent CaO | 50+ | 0.021 | 2.0 |
| 5 | 278-400 | Distilled in the presence | 50+ | 0.028 | 1.5 |

TABLE I-continued

| Run No. | Boiling Point Range Of Cut, ° C. | Treatment | Dielectric Strength, kV | Power Factor At 25° C. | Power Factor At 100° C. |
|---|---|---|---|---|---|
| | | of 3.3 weight per cent CaO | | | |
| 6 | 278–400 | Distilled in the presence of 3.3 weight per cent NaOH | 50+ | 0.025 | 0.8 |
| 7 | 278–400 | Distilled in the presence of 3.3 weight per cent BaO | 50+ | 0.018 | 0.6 |
| 8 | 278–400 | Distilled in the presence of 3.3 weight per cent KOH | Not taken | 0.010 | 0.35 |

Referring to the above, in Run No. 2 the procedure was difficult to carry out because of emulsion problems. Some emulsion problems were also noted in Run No. 3. It can be seen from the data in Table I that greatly improved results are obtained when the dictates of the process employed herein are adhered to. In Run No. 1, wherein the defined cut was not treated, the product possessed an excellent dielectric strength and a good power factor at 25° C. Its dielectric strength at 100° C. was somewhat high. Although there was a slight improvement in the power factor at 100° C. in Run No. 2, as noted emulsion problems were encountered. When the defined cut was treated with sodium hydroxide in Run No. 3 after distillation, its dielectric strength and power factors were adversely affected. However, in each of Runs Nos. 4 to 8 when the distillation was carried out in the presence of the basic material distillation cuts were obtained having improved power factors at 25° and 100° C. In each of Runs 4 to 7 excellent dielectric strengths were obtained. Although no measurement was made of the dielectric strength of the cut in Run No. 8, it is believed the dielectric strength thereof would have been on the same levels as in Runs Nos. 4 to 7.

It is understood that the present compositions can be further treated, if desired, for example, to further improve their properties for a particular purpose, for example, to improve their flash point, interfacial tension, pour point, viscosity, oxidation stability, corrosion resistance, etc.

Obviously, many modifications and variations of the invention, as hereinabove set forth, can be made without departing from the spirit and scope thereof, and therefore only such limitations should be imposed as are indicated in the appended claims.

We claim:

1. A liquid dielectric composition obtained as a result of a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products by distillation while in contact with a basic material selected from the group consisting of Group I and Group II alkali metals and alkaline earth metals, their oxides and hydroxides a fraction having a boiling point in the temperature range of about 255° to about 420° C. as said liquid dielectric composition.

2. The composition of claim 1 wherein said fraction has a boiling point in the range of about 265° to about 400° C.

3. The composition of claim 1 wherein said fraction has a boiling point in the range of about 275° to about 400° C.

4. The composition of claim 1 wherein said basic material is selected from the group consisting of a Group I alkali metal, their oxides and hydroxides.

5. The composition of claim 1 wherein said basic material is selected from the group consisting of a Group II alkaline earth metal, their oxides and hydroxides.

6. The composition of claim 1 wherein said basic material is CaO.

7. The composition of claim 1 wherein said basic material is NaOH.

8. The composition of claim 1 wherein said basic material is BaO.

9. The composition of claim 1 wherein said basic material is KOH.

10. The composition of claim 1 wherein said catalyst is $AlCl_3$.

11. The composition of claim 1 wherein said benzene and said ethylene are reacted in the presence of $AlCl_3$ in a temperature range of about 20° to about 175° C.

12. The composition of claim 1 wherein said benzene and said ethylene are reacted in the presence of $AlCl_3$ in a temperature range of about 90° to about 150° C.

* * * * *